US010499710B2

(12) United States Patent
Innocente

(10) Patent No.: US 10,499,710 B2
(45) Date of Patent: Dec. 10, 2019

(54) FOOTWEAR WITH CLOSING MECHANISM PERMITTING EASY DONNING AND DOFFING

(71) Applicant: NIKE, Inc., Beaverton, OR (US)

(72) Inventor: Claudio Innocente, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 71 days.

(21) Appl. No.: 15/422,364

(22) Filed: Feb. 1, 2017

(65) Prior Publication Data

US 2018/0213890 A1 Aug. 2, 2018

(51) Int. Cl.

| | |
|---|---|
| ***A43C 11/00*** | (2006.01) |
| ***A43C 11/12*** | (2006.01) |
| ***A43C 11/14*** | (2006.01) |
| ***A43B 23/02*** | (2006.01) |
| ***A43B 3/06*** | (2006.01) |
| ***A43B 11/00*** | (2006.01) |

(52) U.S. Cl.

CPC ..... *A43C 11/008* (2013.01); *A43B 3/06* (2013.01); *A43B 11/00* (2013.01); *A43B 23/0245* (2013.01); *A43C 11/12* (2013.01); *A43C 11/1493* (2013.01)

(58) Field of Classification Search

CPC ... A43C 11/008; A43C 11/12; A43C 11/1493; A43B 23/0245

See application file for complete search history.

(56) References Cited

U.S. PATENT DOCUMENTS

| | | | | |
|---|---|---|---|---|
| 2,200,080 | A * | 5/1940 | Fein | A43B 3/24 36/101 |
| 2,302,596 | A | 11/1942 | Bigio | |
| 2,330,224 | A | 9/1943 | L'Hollier | |
| 2,494,770 | A | 1/1950 | MacLaughlin | |
| 2,742,717 | A | 4/1956 | Murray | |
| 4,079,527 | A | 3/1978 | Antonious | |
| 4,451,995 | A * | 6/1984 | Antonious | A43B 23/047 36/51 |
| 4,486,965 | A | 12/1984 | Friton | |
| 4,628,622 | A | 12/1986 | McBarron | |
| 4,665,634 | A | 5/1987 | Diaz | |
| 4,706,392 | A | 11/1987 | Yang | |
| 4,745,693 | A | 5/1988 | Brown | |
| 5,353,483 | A * | 10/1994 | Louviere | A43B 11/00 24/71 SK |

(Continued)

FOREIGN PATENT DOCUMENTS

| | | | |
|---|---|---|---|
| CN | 201995678 | U | 10/2011 |
| DE | 534443 | C | 9/1931 |

(Continued)

OTHER PUBLICATIONS

International Search Report and Written Opinion mailed in corresponding PCT/US2018/015376 dated Mar. 26, 2018.

*Primary Examiner* — Jila M Mohandesi

(74) *Attorney, Agent, or Firm* — Banner & Witcoff, Ltd.

(57) ABSTRACT

A shoe having a toe portion, a heel portion and first and second sides, the shoe including a sole, an upper and a closing mechanism extending from a top portion of the upper down along the first side of the shoe and then horizontally between the sole and the upper around the toe portion, around the second side and around the heel portion.

21 Claims, 6 Drawing Sheets

(56) References Cited

U.S. PATENT DOCUMENTS

| | | | | |
|---|---|---|---|---|
| 6,578,288 | B2 | 6/2003 | Bernstein | |
| 6,874,256 | B2 | 4/2005 | Delgatty | |
| 6,941,683 | B2 | 9/2005 | Freed | |
| 7,127,837 | B2 * | 10/2006 | Ito | A43B 1/0027 36/101 |
| 7,607,242 | B2 | 10/2009 | Karandonis et al. | |
| 7,614,165 | B2 * | 11/2009 | Curry | A43B 1/0081 36/101 |
| D615,734 | S * | 5/2010 | Di Nucci | D2/902 |
| D635,746 | S | 4/2011 | Cofinco | |
| 8,161,669 | B2 | 4/2012 | Keating | |
| D741,054 | S * | 10/2015 | Stillwagon | D2/944 |
| 9,254,017 | B2 * | 2/2016 | Murtha | A43B 3/26 |
| 9,265,305 | B2 | 2/2016 | Hatfield et al. | |
| 9,839,261 | B2 | 12/2017 | Hatfield et al. | |
| 10,178,893 | B1 * | 1/2019 | Baker | A43B 23/0245 |
| 2002/0178616 | A1 | 12/2002 | Williams | |
| 2004/0003516 | A1 * | 1/2004 | Jacobs | A43C 11/008 36/50.1 |
| 2005/0115111 | A1 | 6/2005 | Yamashita | |
| 2008/0168683 | A1 | 7/2008 | Keating | |
| 2008/0229613 | A1 | 9/2008 | Park | |
| 2009/0100717 | A1 | 4/2009 | Cabanis | |
| 2009/0217552 | A1 | 9/2009 | Paintin et al. | |
| 2011/0113650 | A1 | 5/2011 | Hurd et al. | |
| 2011/0296711 | A1 | 12/2011 | Nelson et al. | |
| 2012/0011744 | A1 | 1/2012 | Bell et al. | |
| 2012/0079746 | A1 | 4/2012 | Ferreira et al. | |
| 2012/0198720 | A1 | 8/2012 | Farris et al. | |
| 2014/0047736 | A1 | 2/2014 | Lehmkuhler | |
| 2014/0157624 | A1 | 6/2014 | Girard et al. | |
| 2015/0096201 | A1 * | 4/2015 | Marcon | A43B 7/125 36/109 |
| 2015/0216252 | A1 | 8/2015 | Wiens | |
| 2016/0128429 | A1 | 5/2016 | Hatfield et al. | |
| 2016/0270484 | A1 | 9/2016 | Zadnik | |
| 2016/0338447 | A1 * | 11/2016 | Price, III | A43C 11/12 |

FOREIGN PATENT DOCUMENTS

| | | | |
|---|---|---|---|
| DE | 8203280 | U1 | 11/1982 |
| DE | 3204260 | | 11/1983 |
| DE | 3442147 | | 5/1986 |
| EP | 0094474 | | 11/1983 |
| EP | 1430802 | | 6/2004 |
| FR | 2617379 | | 1/1989 |
| JP | H06315403 | A | 11/1994 |
| JP | H10057112 | A | 3/1998 |
| WO | 2005029991 | A1 | 4/2005 |

* cited by examiner

Fig. 1
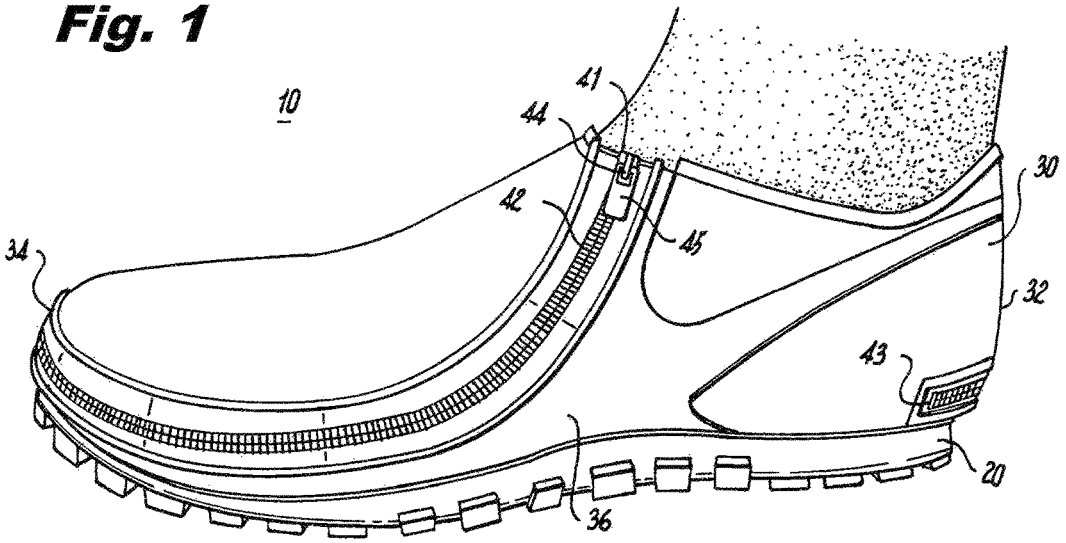
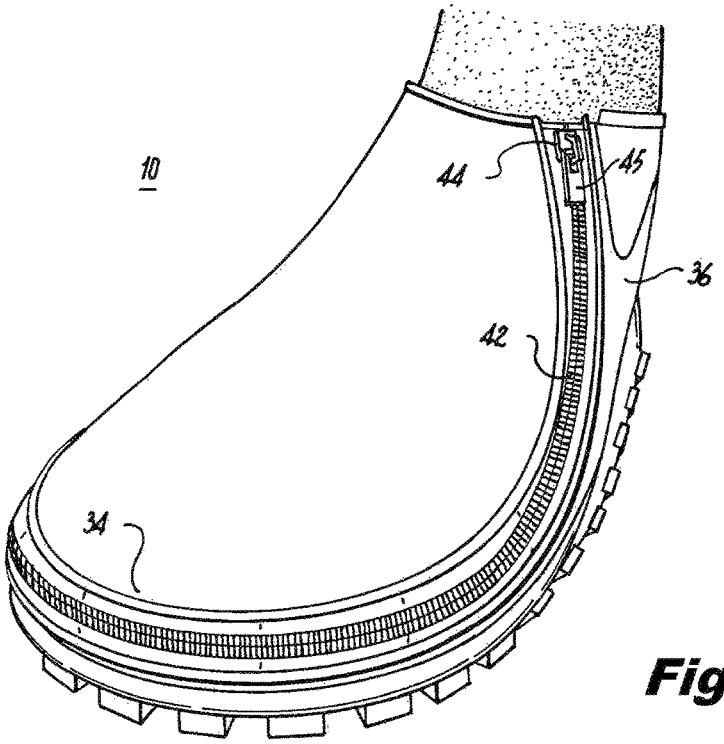
Fig. 2

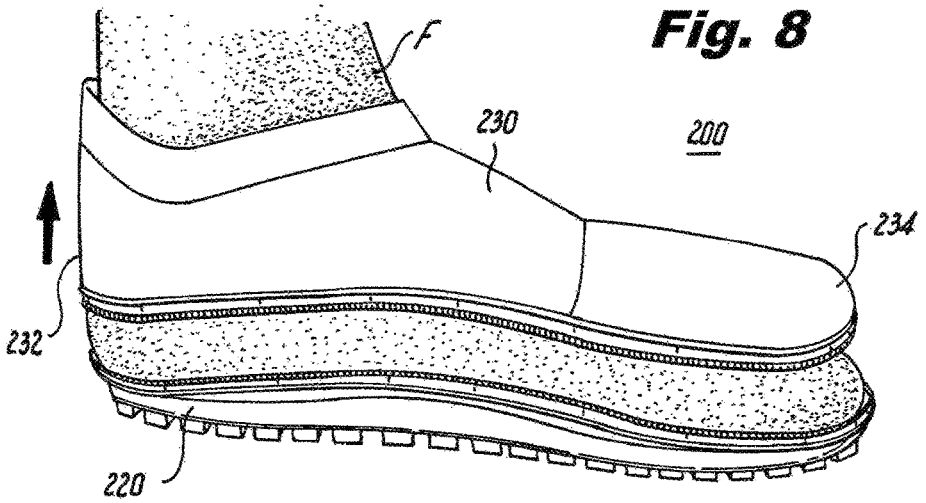
Fig. 8
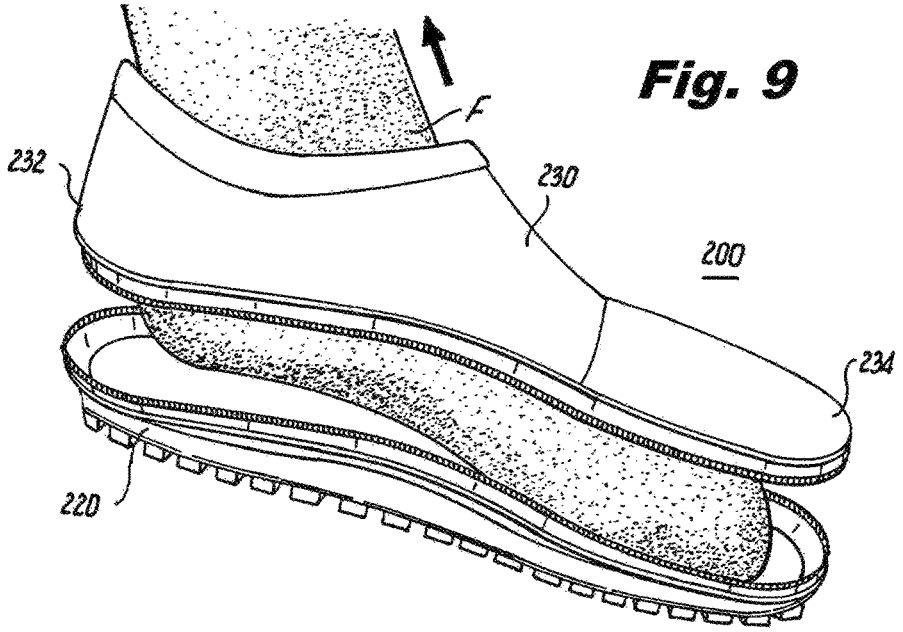
Fig. 9
Fig. 10
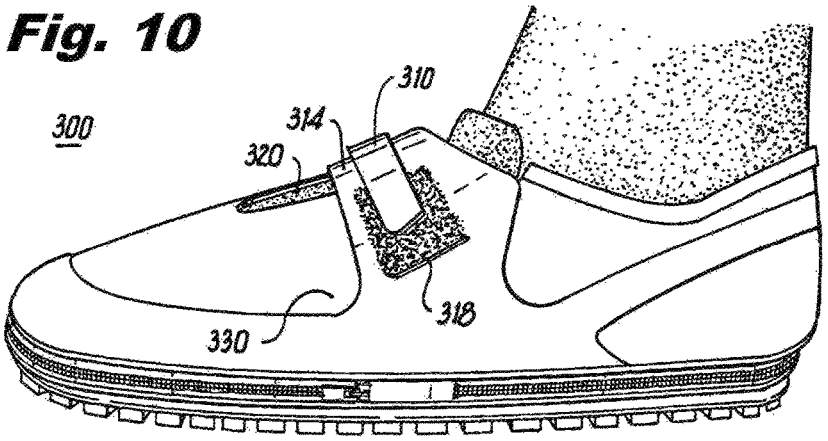

Fig. 11
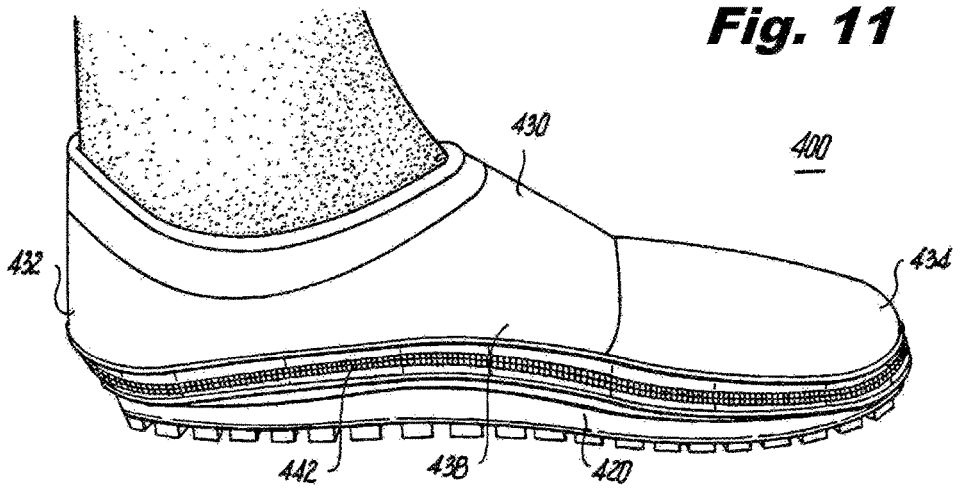
Fig. 12
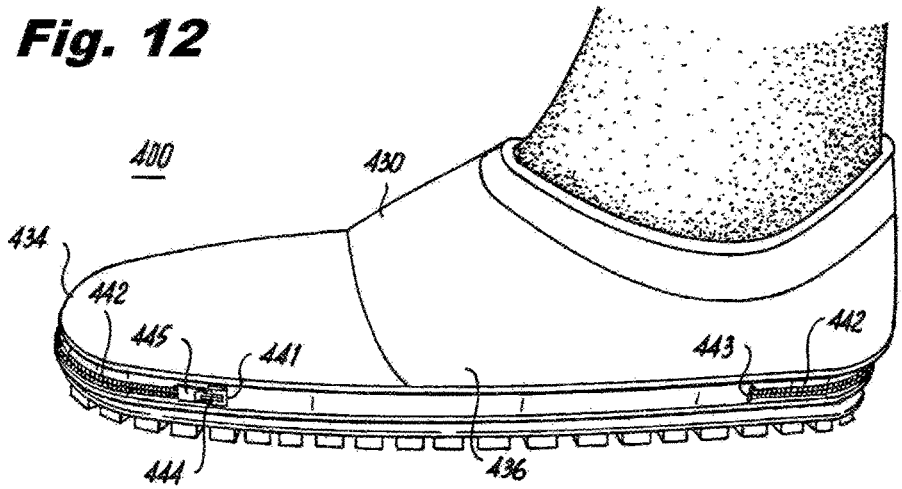
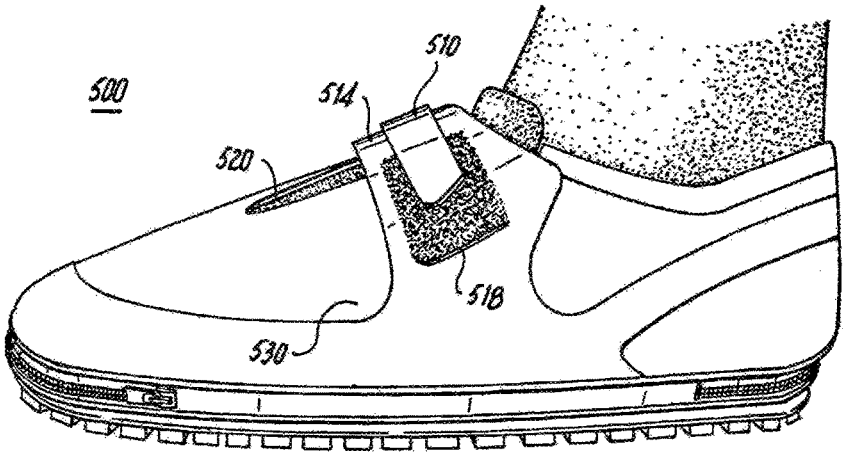
Fig. 13

Fig. 14
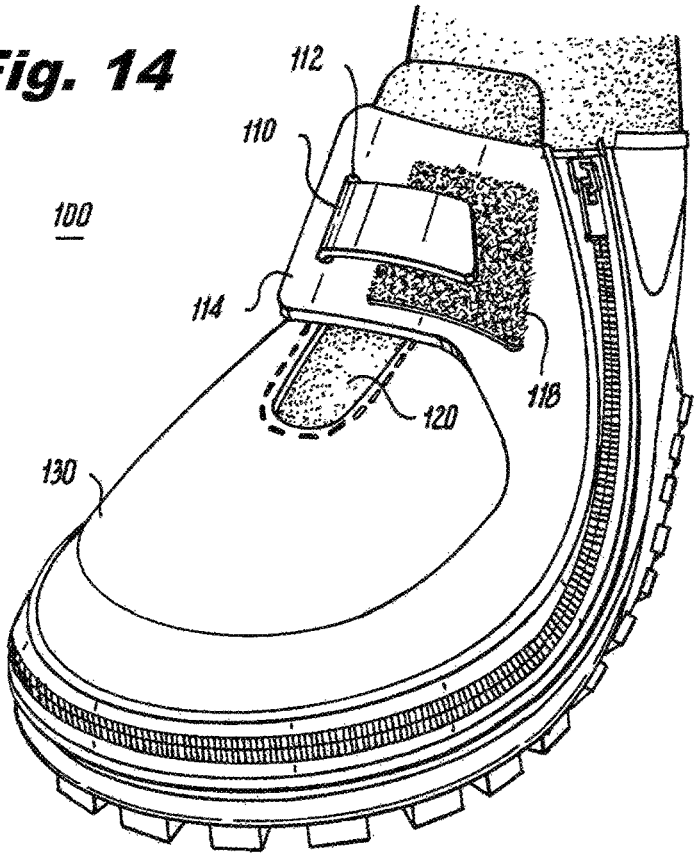
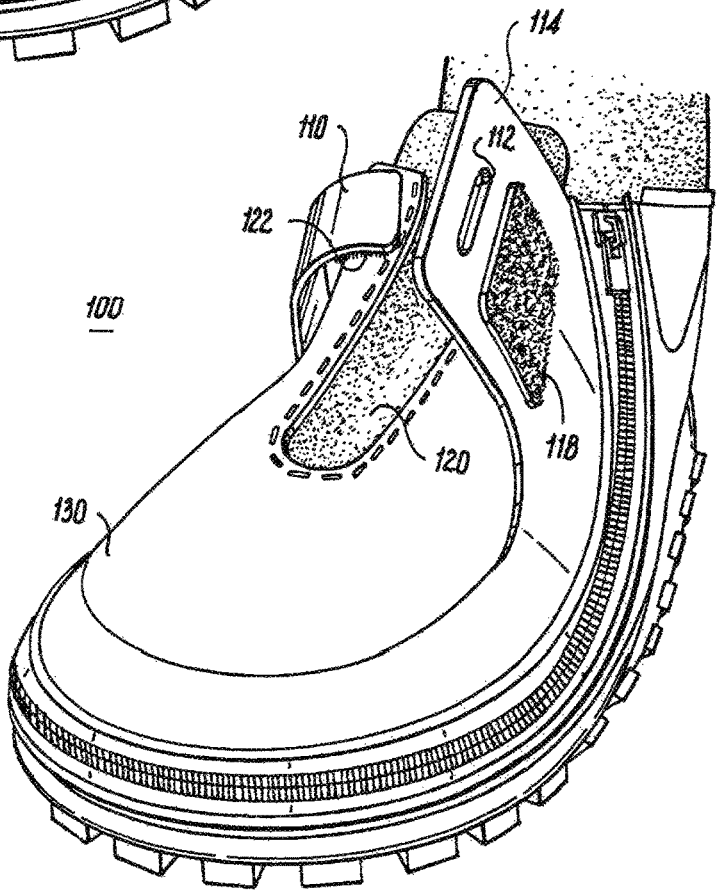
Fig. 15

FOOTWEAR WITH CLOSING MECHANISM PERMITTING EASY DONNING AND DOFFING

BACKGROUND

Field

The present disclosure relates generally to footwear and, more particularly, to footwear with closing mechanism permitting easy donning and doffing.

Description of the Background Art

A variety of different types of shoes have been designed to suit the different lifestyles and activities of people. Such shoes include flip-flops, sandals, mules, slides, clogs, athletic shoes, dress and casual shoes, boots, and even specialty shoes like soccer shoes, bicycling shoes, and dance shoes. Slip-on shoes such as clogs, mules and flip-flops are designed to be slipped on and off with ease and are particularly popular because they permit easy entry into the shoe without the need to widen a foot opening at the top of the shoe and because they generally do not have a heel portion which may require the use of a shoe horn. Shoes for active use generally include a secure closure mechanism such as laces, straps, etc. along the top of the shoe and are used to secure a user's foot against the heel of the shoe so that the shoe does not slip off the foot during the chosen activity. For example, laces or straps extend across the foot opening and can be tightened by the user to secure the foot within the shoe. Slip-on footwear is generally not suitable for active use because such closure mechanisms and heels are absent.

The elderly and handicapped often have difficulty donning and/or doffing shoes. While slip-on shoes such as clogs, mules and flip-flops can be relatively easy for the elderly and handicapped to don and doff, these types of shoes can be dangerous for the elderly and handicapped because they lack heels and thus tend to more easily fall off of the user's foot creating a tripping hazard. Shoes having a heel can be particularly difficult for the elderly and handicapped to don or doff, often requiring the use of a shoe horn or the like. The elderly and handicapped often need assistance donning and doffing their shoes. However, even for those providing assistance, donning and doffing the shoes of the elderly and handicapped can often be a daunting task utilizing currently available shoe designs.

Accordingly, what is needed is a shoe which may be easily and securely donned and doffed with minimum effort. The shoe should have a closing mechanism permitting easy donning and doffing.

SUMMARY

A shoe having a toe portion, a heel portion and first and second sides, the shoe including a sole, an upper and a closing mechanism extending from a top portion of the upper down along the first side of the shoe and then horizontally between the sole and the upper around the toe portion, around the second side and around the heel portion.

A shoe having a toe portion, a heel portion and first and second sides, the shoe including a sole, an upper and a closing mechanism extending horizontally along the first side of the shoe between the sole and the upper around the toe portion of the shoe, around the second side and around the heel portion and along the first side of the shoe.

A shoe having a toe portion, a heel portion and first and second sides, the shoe including a sole, an upper and a closing mechanism extending horizontally along the first side of the shoe at the toe portion and between the sole and the upper, extending around the toe portion, around the second side and around the heel portion and ending along the first side of the shoe at the heel portion.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein:

FIG. 1 is a lateral side view of a shoe according to an embodiment of the present disclosure with zipper closed;

FIG. 2 is a front lateral side perspective view of a shoe according to an embodiment of the present disclosure with zipper closed;

FIG. 8 is a medial side view of a shoe according to an embodiment of the present disclosure showing zipper opened;

FIG. 9 is a medial side view of a shoe according to an embodiment of the present disclosure showing user's foot being removed;

FIG. 10 shows a lateral side view of a shoe according to another embodiment of the present disclosure;

FIG. 11 is a medial side view of a shoe according to another embodiment of the present disclosure;

FIG. 12 is a lateral side view of a shoe according to an embodiment of the present disclosure;

FIG. 13 is a lateral side view of a shoe according to another embodiment of the present disclosure;

FIG. 14 is a front lateral side perspective view of a shoe according to another embodiment of the present disclosure with a strap closure in the closed position; and FIG. 15 is a front lateral side perspective view of a shoe according to another embodiment of the present disclosure with the strap closure in the open position.

DETAILED DESCRIPTION

Figure 3:
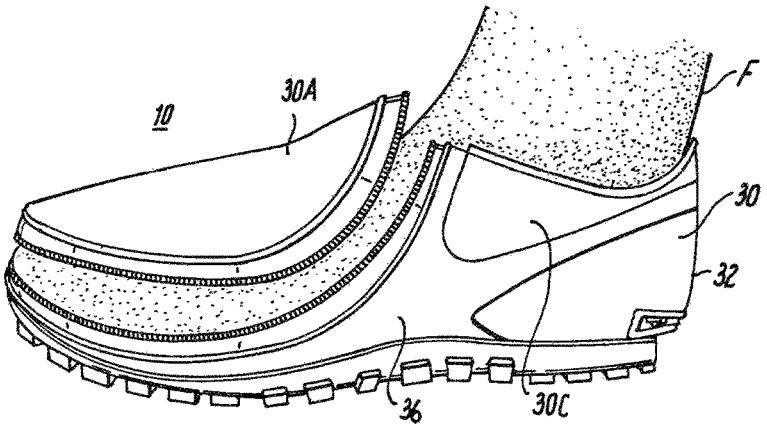
FIG. 3 is a lateral side view of a shoe according to an embodiment of the present disclosure with zipper opened.

The following exemplary embodiments are set forth to aid in an understanding of the subject matter of this disclosure, but are not intended, and may not be construed, to limit in any way the claims which follow thereafter. Therefore, while specific terminology is employed for the sake of clarity in describing some exemplary embodiments, the present disclosure is not intended to be limited to the specific terminology so selected, and it is to be understood that each specific element includes all technical equivalents which operate in a similar manner.

The term "shoe" as recited in the present disclosure is used in the generic sense to identify any type of footwear that can be worn on a user's foot. For example, the term "shoe" as used herein includes, but is not limited to, casual footwear, formal footwear, dress footwear, work footwear, athletic footwear, etc.

A shoe 10 according to an embodiment of the present disclosure is shown in FIGS. 1-5. Shoe 10 includes upper 30 and sole 20. Shoe 10 is described herein as including a heel or heel portion 32, a toe or toe portion 34, a lateral side 36 and a medial side 38. These labels are provided only for ease in referencing various portions of the shoes described herein and are not intended to be otherwise limiting. A closing mechanism such as, for example, zipper 42 extends from the top of the upper 30 down along the lateral side 36 of upper 30 and then horizontally along an edge between the upper 30 and the sole 20 around toe portion 34, around the medial side 38 and wraps around the heel portion 32, ending along a lateral side 36 of heel portion 32 as shown in FIG. 1. Zipper 42 includes top stops 41 provided at the top of the upper 30 and bottom stops 43 provided at the lateral side of heel 32. A slider body 44 including a pull tab 45 is provided as shown. According to another embodiment of the present disclosure, an additional slider body may be provided at the end of zipper 42 at the lateral side of heel 32. In this way, zipper 42 can be opened and closed from either end or both ends of zipper 42.

Figure 4:
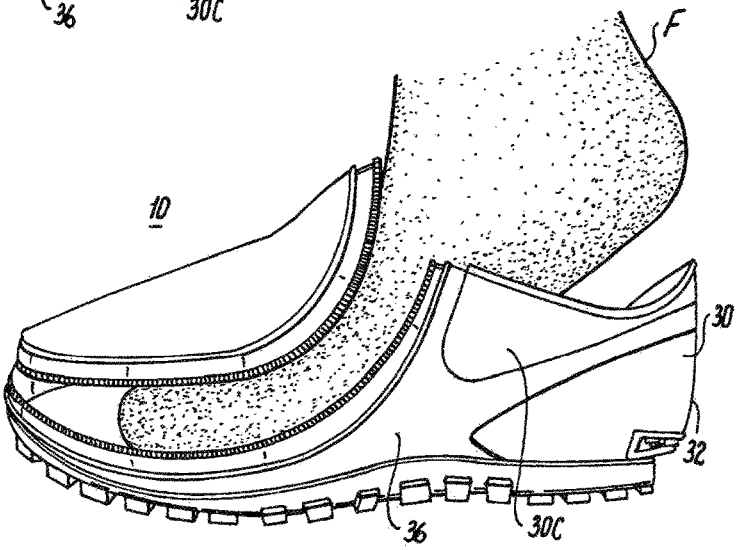
FIG. 4 is a lateral side view of a shoe according to an embodiment of the present disclosure showing user's foot being removed.
Figure 5:
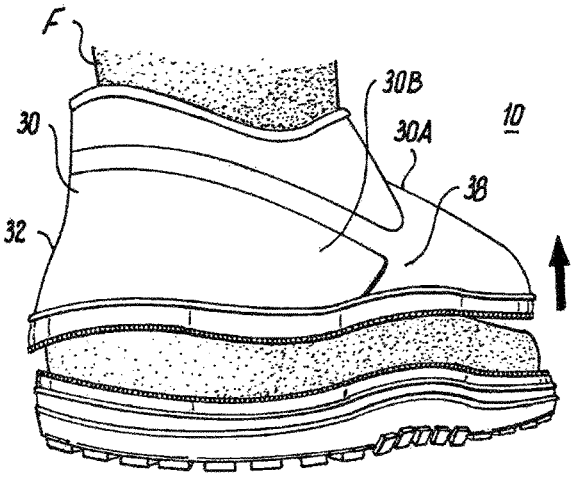
FIGS. 5 is a rear medial side perspective view of a shoe according to an embodiment of the present disclosure showing zipper fully opened.
Figure 6:
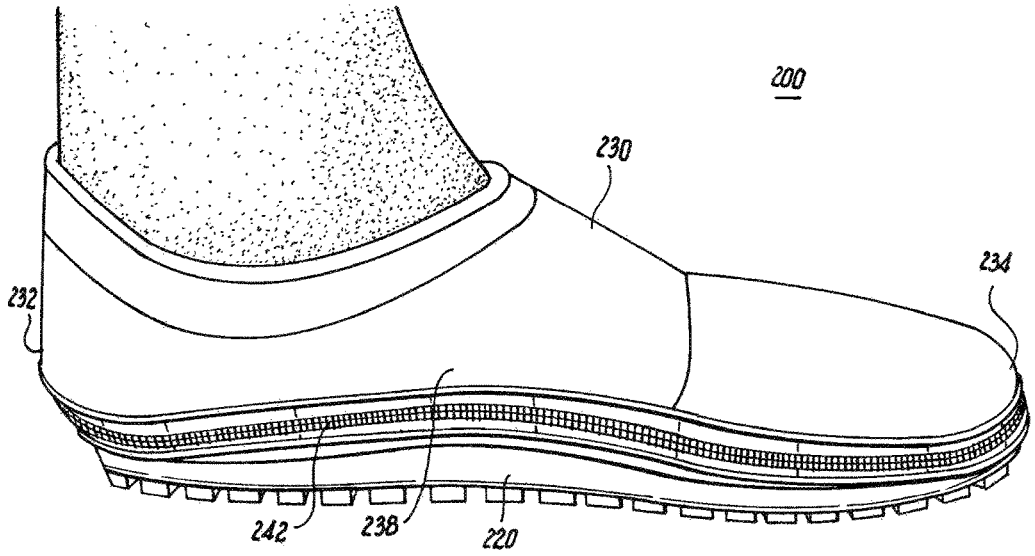
FIG. 6 is a medial side view of a shoe according to another embodiment of the present disclosure.

As shown in FIGS. 3-5, upper 30 includes portion 30A forming the vamp and toe box portions of the shoe, medial side portion 30B forming the medial side and lateral side portion 30C forming the lateral quarter of shoe 10. Only lateral side portion 30C is attached directly to the sole of shoe 10, with the remainder being removably attached via zipper 42. When zipper 42 is fully opened as shown in FIG. 5, the user's foot F can be readily inserted and removed from shoe 10.

FIGS. 14 and 15 depict a shoe 100 which is substantially similar to shoe 10 shown in FIGS. 1-5. However, according to this embodiment of the present disclosure, the upper 130 includes a strap 110 which is sewn or otherwise attached to the medial side of upper 130. A section of a hook and loop fastener 122, such as Velcro®, is sewn or otherwise attached to an underside of strap 110. A flap 114 extends from a lateral side portion of upper 130. Flap 114 has an oblong orifice 112 dimensioned to receive strap 122 and includes a corresponding section 118 of the hook and loop fastener, such as Velcro®, which is sewn or otherwise attached thereto. Strap 110 can be slipped through orifice 112 and secured using the sections 122 and 118 of the hook and loop fastener as shown in FIG. 14. According to an embodiment of the present disclosure, in order to provide additional comfort, an elastic section of material 120 is sewn to or otherwise attached to shoe 100 in an area that may be referred to as the tongue portion of shoe 100.

A shoe 200 according to another embodiment of the present disclosure is shown in FIGS. 6-9. Shoe 200 includes upper 230 and sole 220. Shoe 200 is described herein as including a heel or heel portion 232, a toe or toe portion 234, a lateral side 236 and a medial side 238. These labels are provided only for ease in referencing various portions of the shoes described herein and are not intended to be otherwise limiting. A closing mechanism such as, for example, zipper 242 is provided between upper 230 and sole 220. Zipper 242 begins on the lateral side 236 of shoe 200 and extends around the medial side 238 and ends on the lateral side 236. Zipper 242 includes top stops 241 provided at one end and bottom stops 243 provided at the other end. A slider body 244 including a pull tab 245 is provided as shown. According to another embodiment of the present disclosure, a slider body may be provided at both ends of zipper 242. In this way, zipper 242 can be opened and closed from either end or both ends of zipper 242.

Figure 7:
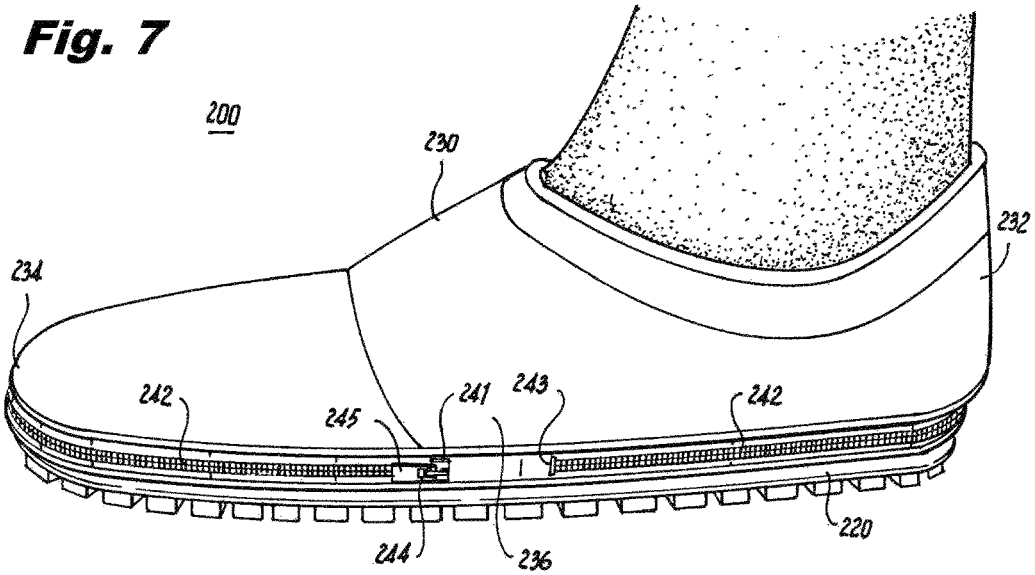
FIG. 7 is a lateral side view of a shoe according to an embodiment of the present disclosure.

As shown in FIGS. 6-9, upper 230 includes one or more sections of material forming the entire upper including the vamp and toe box, the medial and lateral sides and the heel portion. As shown in FIG. 7, only a relatively small portion of upper 230 is attached directly to the sole of shoe 200 (between zipper ends), with the remainder being removably attached via zipper 242. When zipper 242 is fully opened as shown in FIG. 9, the user's foot F can be readily inserted and removed from shoe 200.

FIG. 10 depicts a shoe 300 which is substantially similar to shoe 200 shown in FIGS. 6-9. However, according to this embodiment of the present disclosure, shoe 300 includes a strap arrangement similar to that shown in FIGS. 14, 15. For example, the upper 330 includes a strap 310 which is sewn or otherwise attached to the medial side of upper 330. A section of a hook and loop fastener, such as Velcro® (not shown), is sewn or otherwise attached to an underside of strap 310. A flap 314 extends from a lateral side portion of upper 330. Flap 314 has an orifice (not shown) dimensioned to receive strap 310 and includes a corresponding section 318 of the hook and loop fastener, such as Velcro®, which is sewn or otherwise attached thereto. Strap 310 can be slipped through the orifice and secured using the sections of the hook and loop fastener as shown in FIG. 10. According to an embodiment of the present disclosure, in order to provide additional comfort, an elastic section of material 320 may be sewn to or otherwise attached to shoe 300 in an area that may be referred to as the tongue portion of shoe 300.

A shoe 400 according to another embodiment of the present disclosure is shown in FIGS. 11 and 12. Shoe 400 includes upper 430 and sole 420. Shoe 400 is described herein as including a heel or heel portion 432, a toe or toe portion 434, a lateral side 436 and a medial side 438. These labels are provided only for ease in referencing various portions of the shoes described herein and are not intended to be otherwise limiting. A closing mechanism such as, for example, zipper 442 is provided between upper 430 and sole 420. Zipper 442 begins on the lateral side 436 of shoe 400 at the toe portion 434 and extends around the medial side 438 and ending on the lateral side 436 at the heel portion 432. Zipper 442 includes top stops 441 provided at one end and bottom stops 443 provided at the other end. A slider body 444 including a pull tab 445 is provided as shown. According to another embodiment of the present disclosure, a slider body may be provided at both ends of zipper 442. In this way, zipper 442 can be opened and closed from either end or both ends of zipper 442.

As shown in FIGS. 11 and 12, upper 430 includes one or more sections of material forming the entire upper including the vamp and toe box, the medial and lateral sides and the heel portion. As shown in FIG. 12, a portion of upper 430 is attached directly to sole 420 along substantially the entire lateral side 436 of shoe 400 (between zipper ends), with the remainder being removably attached via zipper 442. When zipper 442 is fully opened, the user's foot can be readily inserted and removed from shoe 400.

FIG. 13 depicts a shoe 500 which is substantially similar to shoe 400 shown in FIGS. 11 and 12. However, according to this embodiment of the present disclosure, shoe 500 includes a strap arrangement similar to that shown in FIGS. 14 and 15. For example, the upper 530 includes a strap 510 which is sewn or otherwise attached to the medial side of upper 530. A section of a hook and loop fastener, such as Velcro® (not shown), is sewn or otherwise attached to an underside of strap 510. A flap 514 extends from a lateral side portion of upper 530. Flap 514 has an orifice (not shown)

dimensioned to receive strap 510 and includes a corresponding section 518 of the hook and loop fastener, such as Velcro®, which is sewn or otherwise attached thereto. Strap 510 can be slipped through the orifice and secured using the sections of the hook and loop fastener as shown in FIG. 13. According to an embodiment of the present disclosure, in order to provide additional comfort, an elastic section of material 520 is sewn to or otherwise attached to shoe 500 in an area that may be referred to as the tongue portion of shoe 500.

Various embodiments described herein depict the closing mechanism or zipper extending from the lateral side of the shoe around the medial side, wrapping around the heel portion and ending on the lateral side. Of course, other arrangements including mirror images of the above described embodiments are contemplated. For example, a closing mechanism such as, for example, a zipper may extend from the medial side of the shoe and then horizontally along an edge of the upper and the sole, around the lateral side and wrapping around the heel and, ending along a medial side of heel.

According to the various embodiments of the present disclosure, the shoes as described herein may include a rubber toe cover that wraps around the toe box portion of the shoe. The uppers may be formed from one or more sections of material and may include, quarters, cuffs, etc. The material forming the upper may be leather, cloth, plastic, rubber, synthetic fabric such as nylon, etc. or any combination thereof and may include multiple layers of material as desired. The sole of the shoe may be formed from one or more sections of material and may include one or more layers of material. For example, the sole may include a hard or soft rubber bottom having one or more padding layers on top thereof to provide comfort to the user.

Footwear with closing mechanism permitting easy donning and doffing have been described in terms of particular embodiments. Of course, other embodiments are within the scope of the following claims.

Numerous additional modifications and variations of the present disclosure are possible in view of the above-teachings. It is therefore to be understood that within the scope of the appended claims, the present disclosure may be practiced other than as specifically described herein. For example, elements and/or features of different illustrative embodiments may be combined with each other and/or substituted for each other within the scope of this disclosure and appended claims.

What is claimed is:

1. A shoe having a toe portion, a heel portion, a first side, and a second side opposite the first side, the shoe comprising:

a sole;

an upper permanently attached to the sole only at the first side of the shoe; and a zipper mechanism extending continuously from: (a) a top portion of the upper at the first side of the shoe, (b) downward and along the first side of the shoe, (c) along an edge between the sole and the upper around the toe portion, (d) along the edge between the sole and the upper and along the second side, and (e) along the edge between the sole and the upper and around the heel portion, wherein the zipper mechanism includes a zipper end stop located at the first side of the shoe where the upper is permanently attached to the sole.

2. The shoe as recited in claim 1, wherein the first side comprises a lateral side and the second side comprises a medial side of the shoe.

3. The shoe as recited in claim 1, wherein the first side comprises a medial side and the second side comprises a lateral side of the shoe.

4. The shoe as recited in claim 1, further comprising:

a strap member extending across the upper from the first side of the shoe to the second side of the shoe; and a flap member extending across the upper from the second side of the shoe towards the first side of the shoe, the flap member including an orifice dimensioned for receiving the strap member.

5. The shoe as recited in claim 4, further comprising connecting members provided on the flap member and the strap member for connecting the strap member to the flap member.

6. The shoe as recited in claim 5, wherein the connecting members comprise a hook and loop fastener.

7. The shoe as recited in claim 4, further comprising an elastic section of material provided at a portion of the upper below the strap member and the flap member.

8. A shoe having a toe portion, a heel portion, a first side, and a second side opposite the first side, the shoe comprising:

a sole;

an upper permanently attached to the sole only at the first side of the shoe; and a zipper mechanism extending continuously from a first zipper end stop to a second zipper end stop of the zipper mechanism, wherein the zipper mechanism extends: (a) along an edge between the sole and the upper from the first zipper end stop and along the first side of the shoe, (b) along the edge between the sole and the upper and around the toe portion of the shoe, (c) along the edge between the sole and the upper and along the second side, (d) along the edge between the sole and the upper and around the heel portion, and (e) along the edge between the sole and the upper and along the first side of the shoe to the second zipper end stop, wherein the upper is permanently attached to the sole only at the first side of the shoe between the first zipper end stop and the second zipper end stop.

9. The shoe as recited in claim 8, wherein the first side comprises a lateral side and the second side comprises a medial side of the shoe.

10. The shoe as recited in claim 8, wherein the first side comprises a medial side and the second side comprises a lateral side of the shoe.

11. The shoe as recited in claim 8, further comprising:

a strap member extending across the upper from the first side of the shoe to the second side of the shoe;

a flap member extending across the upper from the second side of the shoe towards the first side of the shoe, the flap member including an orifice dimensioned for receiving the strap member.

12. The shoe as recited in claim 10, further comprising connecting members provided on the flap member and the strap member for connecting the strap member to the flap member.

13. The shoe as recited in claim 11, wherein the connecting members comprise a hook and loop fastener.

14. The shoe as recited in claim 11, further comprising an elastic section of material provided at a portion of the upper below the strap member and the flap member.

15. A shoe having a toe portion, a heel portion, a first side, and a second side opposite the first side, the shoe comprising:

a sole;

an upper permanently attached to the sole only at the first side of the shoe; and a zipper mechanism extending continuously from a first zipper end stop located at the toe portion on the first side of the shoe to a second zipper stop located at the heel portion on the first side of the shoe, wherein the zipper mechanism extends: (a) from the first zipper end stop at the toe portion along an edge between the sole and the upper, (b) along the edge between the sole and the upper and around the toe portion, (c) along the edge between the sole and the upper and along the second side, (d) along the edge between the sole and the upper and around the heel portion, and (e) along the edge between the sole and the upper to the first side of the shoe and to the second zipper end stop at the heel portion, wherein the upper is permanently attached to the sole only at the first side of the shoe between the first zipper end stop and the second zipper end stop.

16. The shoe as recited in claim 15, wherein the first side comprises a lateral side and the second side comprises a medial side of the shoe.

17. The shoe as recited in claim 15, wherein the first side comprises a medial side and the second side comprises a lateral side of the shoe.

18. The shoe as recited in claim 15, further comprising:

a strap member extending across the upper from the first side of the shoe to the second side of the shoe;

a flap member extending across the upper from the second side of the shoe towards the first side of the shoe, the flap member including an orifice dimensioned for receiving the strap member.

19. The shoe as recited in claim 18, further comprising connecting members provided on the flap member and the strap member for connecting the strap member to the flap member.

20. The shoe as recited in claim 19, wherein the connecting members comprise a hook and loop fastener.

21. The shoe as recited in claim 18, further comprising an elastic section of material provided at a portion of the upper below the strap member and the flap member.

* * * * *